United States Patent [19]

Lüssi

[11] Patent Number: 4,872,657

[45] Date of Patent: Oct. 10, 1989

[54] OPERATING TABLE WITH A PATIENT SUPPORT SURFACE TILTABLE AROUND THE LONGITUDINAL AND TRANSVERSE AXES

[75] Inventor: André Lüssi, Wabern, Switzerland

[73] Assignee: M. Schaerer AG, Wabern, Switzerland

[21] Appl. No.: 107,337

[22] Filed: Oct. 13, 1987

[30] Foreign Application Priority Data

Oct. 17, 1986 [CH] Switzerland ..... 4151/86

[51] Int. Cl.[4] ..... A61G 13/00

[52] U.S. Cl. ..... 269/325

[58] Field of Search ..... 269/322, 323, 324, 325, 269/326

[56] References Cited

U.S. PATENT DOCUMENTS

| | | | |
|---|---|---|---|
| 3,868,103 | 2/1975 | Pageot et al. | 269/325 |
| 4,148,472 | 4/1979 | Rais et al. | 269/325 |
| 4,195,829 | 4/1980 | Reser | 269/325 |

*Primary Examiner*—William L. Sikes

*Attorney, Agent, or Firm*—Pearne, Gordon, McCoy & Granger

[57] ABSTRACT

A control panel (14) contains four control levers (18). A control valve having a valve slide (55) capable of sliding in a valve sleeve (79) is assigned to each control lever (18). An electric motor (68) on whose drive shaft (70) a bevel gear (64) is mounted in a rotationally solid manner is also provided for each control lever (18). The bevel gear (64) engages with another bevel gear (66) that is connected with a shaft journal (62) in a rotationally solid manner. A follower pin (72) is eccentrically mounted in the shaft journal (64); it passes through one end of a push rod (57) and projects into a groove (73) in a shaft journal (58) passed through by the assigned control lever (18). In this manner, the two shaft journals (58, 62) are connected with each other through the follower pin (72) in a rotational manner. The other end of the push rod (57) is connected through a coupling (75) with a piston rod (56) that is in turn fastened to the valve slide (55). In the arrangement described above, the control valve can be actuated at any time either by the control lever (18) or the electric motor (68). The simultaneous action of the control lever and the electric motor on the control valve is also possible without damage resulting thereby.

8 Claims, 6 Drawing Sheets

OPERATING TABLE WITH A PATIENT SUPPORT SURFACE TILTABLE AROUND THE LONGITUDINAL AND TRANSVERSE AXES

BACKGROUND OF THE INVENTION

The invention concerns an operating table having movable sections which may be remotely controlled.

PRIOR ART

An operating table is described in Swiss Pat. No. 615,587, in which a patient support surface divided into sections is tiltably situated on a support column. The support column rests on a movable table base. The individual sections of the patient support surface can be swung relative to each other around their transverse axes, in which case the pivoting movement is effected by hydraulic cylinders. The hydraulic cylinders are actuated by control valves that are located in a control panel. The control valves can be operated by control levers projecting out of the control panel.

It is frequently desirable that the operating table, which is located in a sterile zone, can be operated from a station located outside the zone, i.e., to adjust the sections of the patient support surface and/or the height of the latter. This is not possible with the conventional operating table.

SUMMARY OF THE INVENTION

The invention provides an operating table that can be operated from outside of the sterile zone in which it is located, in which case the possibility of adjusting it from the operating table itself is simultaneously retained.

Other objects of the invention are elucidated in greater detail in the following with reference to the drawings.

DETAILED DESCRIPTION OF THE DRAWINGS

Figure 1:
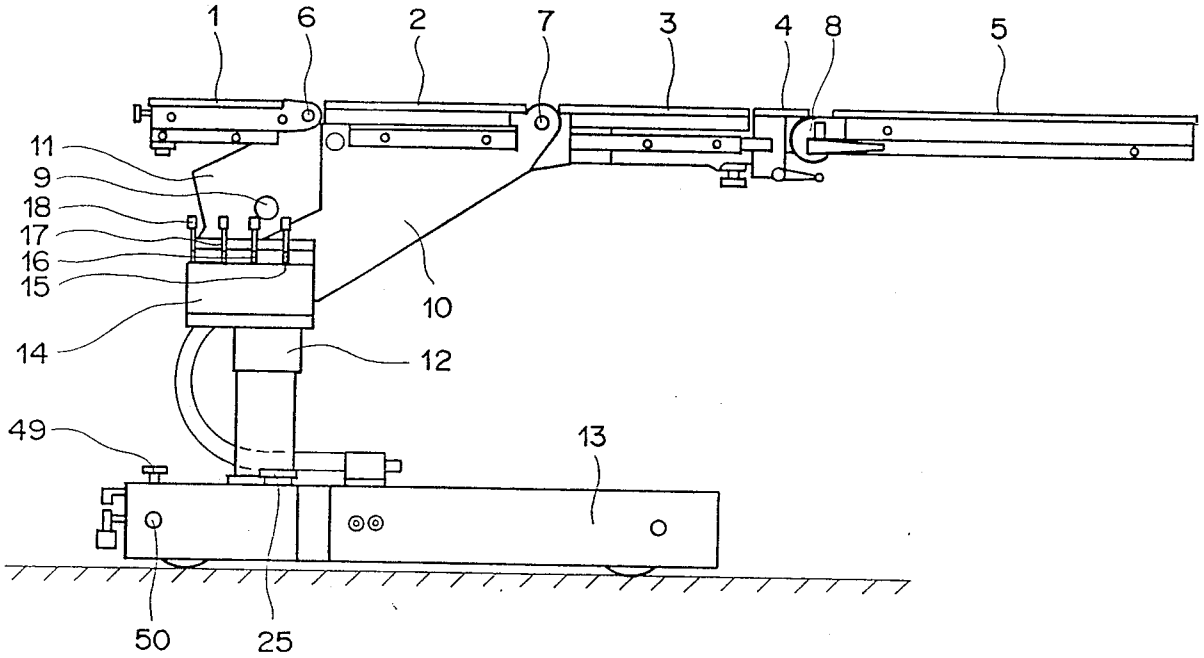
FIG. 1 shows an exemplary embodiment of the operating table according to the invention in graphic representation.

The operating table shown in FIG. 1 has a patient support surface divided into sections 1, 2, 3, 4, and 5, which are pivotal relative to each other around the transverse axes 6, 7, and 8. The entire patient support surface can also be swung around a transverse axis 9. The section 2 rests on a support stand 10 that has a saddle 11 which is tiltable around the transverse axis 9 and around a longitudinal axis (not shown). The transverse axis 9 is supported in the upper part of a support column 12, which in turn projects upward from a table base 13. The support column 12 is telescoping so that the patient support surface is adjustable with regard to height. A control panel 14 is mounted on the support stand 10; the control levers 15–18 project out of it. The control panel 14 contains control valves that are not shown in FIG. 1 but are described in greater detail below.

Figure 2:
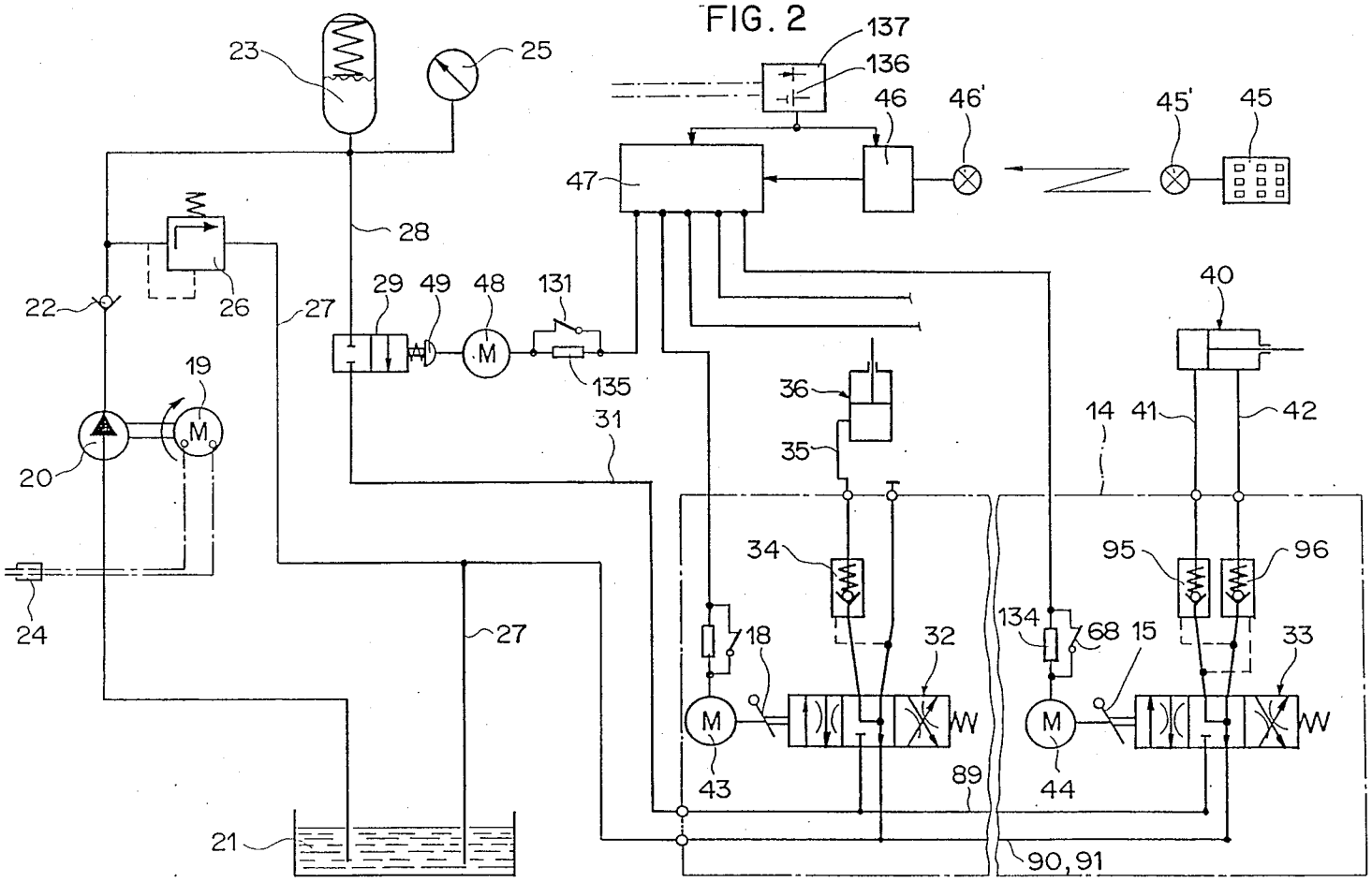
FIG. 2 shows a schematic representation of the hydraulic system.

FIG. 2 shows the hydraulic system of the operating table according to FIG. 1. The hydraulic system is comprised of a pump 20 that can be driven by an electric motor 19. The pump 20 delivers oil under pressure from a reservoir 21, through a check valve 22, into a pressure accumulator 23 when the electric motor 19 is connected via a plug connection 24 to the a.c. network. The pressure in the pressure accumulator 23 can be read on a manometer 25.

An overpressure pressure relief valve 26 prevents excessive pressure from arising in the pressure reservoir 23. The excess oil returns via a return line 27 to the reservoir 21.

The oil is conveyed through a pipeline 28 and a standby valve 29, and through a pipeline 31 into the control panel 14, only a portion of which is shown schematically in FIG. 2. Four control valves, corresponding to the four control levers 15–18, are located in the control panel 14, each of which is assigned to one of the control levers 15–18.

FIG. 2 shows only the two control valves 32 and 33 that are assigned to the control levers 15 and 18.

Oil passes via the control valve 32 through an openable check valve 34 and a pipeline 35 to a drive cylinder 36 located in the support column 12 for raising the patient support surface when the control lever 18 is swung to the right in FIG. 2. If the control lever 18 is swung in the opposite direction, i.e., to the left, oil passes through the control valve 32 into the openable check valve 34, by which the latter is opened, for lowering the patient support surface. The oil present in the working cylinder 36 can flow back into the reservoir 21 through the pipeline 35, the opened check valve 34, the control valve 32, and the return line 27.

Analogously, the control valve 33 can be actuated with the control lever 15 and oil can be fed to a drive cylinder 40, for example, connected to the control valve 33 via pipelines 41 and 42, for swinging the section 3 of the patient support surface around the transverse axis 7.

The control panel 14 also contains four electric motors, each of which is assigned to one of the control levers 15–18 and the control valves 32, 33, and only those designated 43 and 44 are shown in FIG. 2. A remote control device comprised of a sender 45 and a receiver 46 is also provided. A driver stage 47 with, for example, five outputs is connected to the receiver 46. The first output of the driver stage 47 is connected with an electric motor 48, which serves for remote actuation of the standby valve 29. Each of the other four outputs is connected with one of the electric motors 43 and 44 in the control panel 14. The remote control signals generated by the sender 45 are fed to a luminous diode 49 and transferred as light signals to a photocell 46' and received in the receiver 46 and fed processed to the driver stage 47. The photocell 46' is located in the table base 13 ( see FIG. 1).

Figure 4:
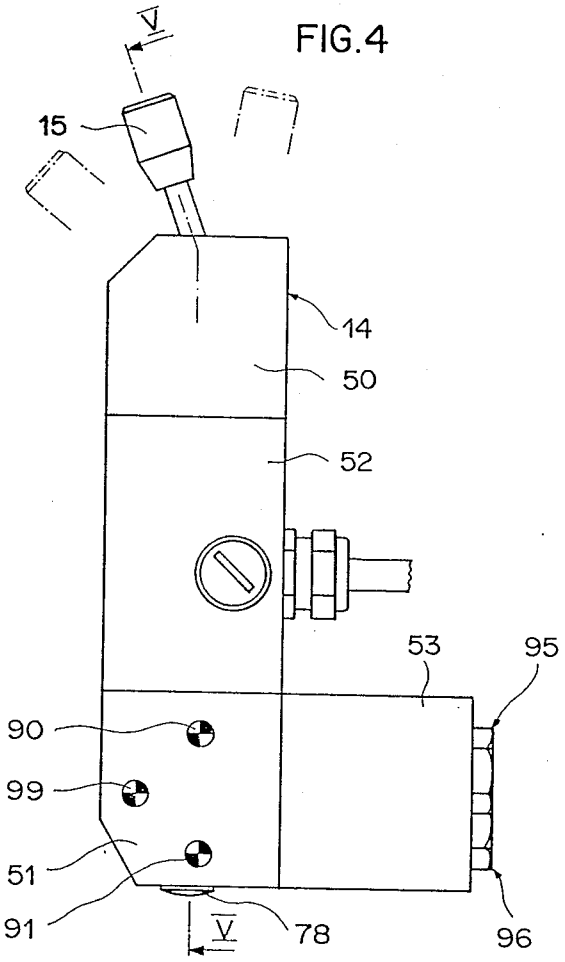
FIG. 4 shows the side view of the control panel according to FIG. 3.
Figure 3:
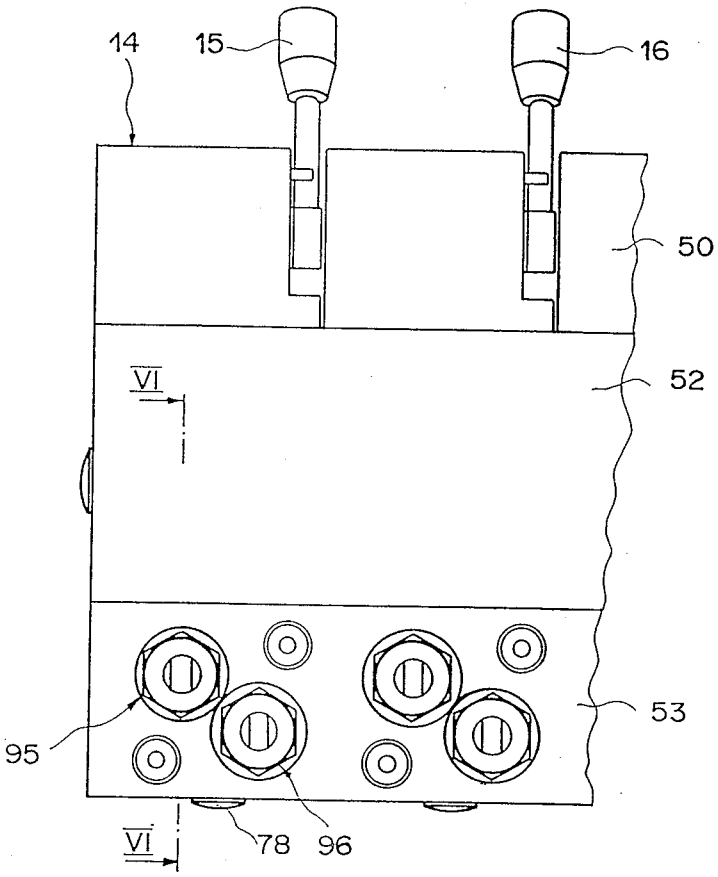
FIG. 3 shows a rear view of a portion of a control panel.
Figure 5:
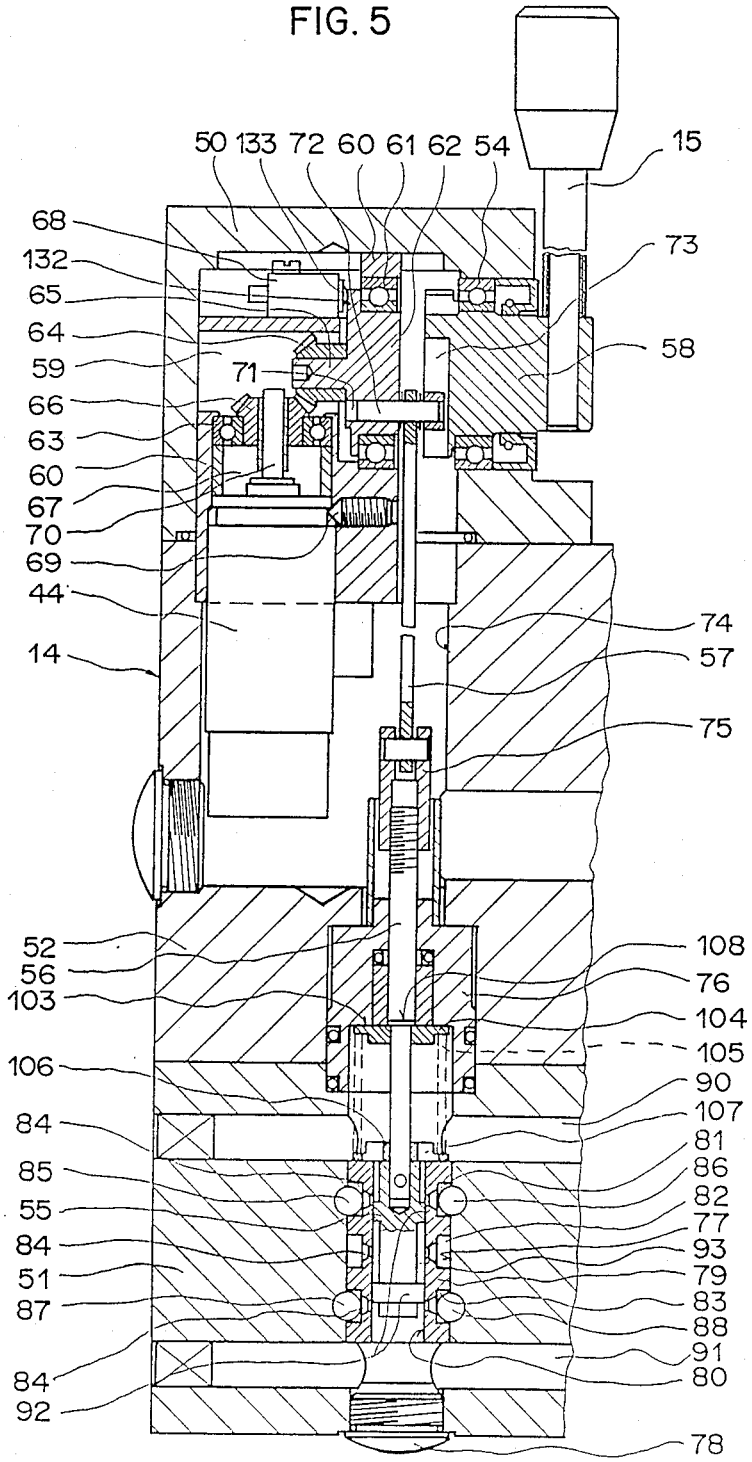
FIG. 5 shows a section along the line V—V of FIG. 4.
Figure 6:
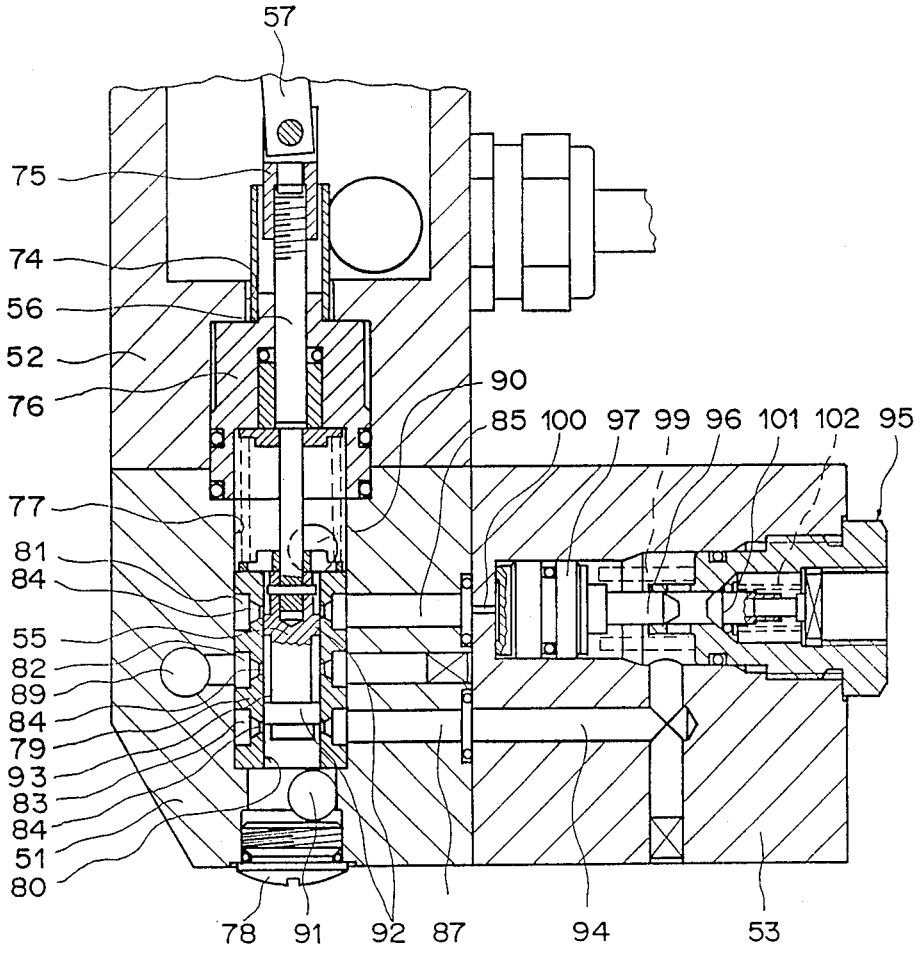
FIG. 6 shows a section along the line VI—VI of FIG. 3.

FIG. 3 shows a portion of the control panel 14, with the two control levers 15 and 16 in the rear view, and FIG. 4 shows the control panel 14 in the side view. It is evident from FIGS. 4 and 5 that the control panel 14 consists of four blocks 50–53. The ball bearings 54 for the control levers 15–18 are located in the bearing block 50, where only the control lever 15 and the ball bearing 54 assigned to it are shown in FIG. 5. The moveable valve slides 55 are supported in the control valve block 51 so as to slide in the longitudinal bores 80 of the valve bushing 79. The linkage block 52 is located between the bearing block 50 and the control valve block 51 and encompasses a portion of a piston rod 56 that is displaceable only axially or a push rod 57 pivotally connected with the piston rod 56. The connections for the drive cylinders 36 and 40 and the check valves, only one of which (95) is shown in FIG. 6, are located in the check valve block 53 mounted on the control valve block 51.

According to FIG. 5, the control lever 18 passes through a shaft journal 58 supported in the ball bearing 54. A gear drive block 60 is inserted in a recess 59 of the bearing block 50. The gear drive block 60 has a first ball bearing 61 for an additional shaft journal 62 and a second ball bearing 63 for a bevel gear 66. The axis of rotation of the additional shaft journal 62 and that of the shaft journal 58 are located on a straight line. The shaft journal 62 has an added piece 65 concentric to the axis of rotation, on which an additional bevel gear 64 that engages with the said bevel gear 66 is placed in a rotationally solid manner.

A portion of the electric motor 44 is located in a recess 67 concentric to the axis of rotation of the bevel gear 66 and is held therein by means of a setscrew 69. The drive axis 70 of the electric motor 44 extends through the bevel gear 66 and is connected with it in a rotationally solid manner.

A follower pin 72 that is eccentric to the axis of rotation is inserted in a bore 71 that runs parallel to the axis of rotation of the additional shaft journal 62. In order to illustrate the eccentric arrangement of the follower pin 72, the shaft journal 62 is shown in FIG. 5, turned by 90 degrees around its axis of rotation. In the central position of the slide 55 shown in FIG. 5, the follower pin 72 would be at the same height as the axis of rotation of the shaft journal 62, and the eccentric arrangement could not be detected.

The follower pin 72 projects out of the bore 71 in the direction of the shaft journal 58 and into a radial groove 73 of the shaft journal 58. In this manner, the two shaft journals 58 and 62 are connected together in a rotationally solid manner.

The follower pin 72 also extends through the one end of the push rod 57. The latter extends into a bore 74 in the linkage block 52 up to a coupling piece 75 that connects the push rod 57 with the piston rod 56. The bore 74 is expanded in the lower zone and a guide sleeve 76 for the piston rod is inserted into the expanded portion of the bore 74.

An aligning bore 77 is present in the control valve block 51, coaxial to the bore 74 in the linkage block 52. The lower end of the bore 77 is closed off by a screw plug 78. One of the valve sleeves 79 is inserted in a stationary manner in the middle region of the bore 77. The valve sleeve 79 has the longitudinal bore 80, in which the valve slide 55 connected with the piston rod 56 is slidably supported.

Three grooves 81, 82, and 83 that extend along the periphery and are connected through radial bores 84 with the longitudinal bore 80 are also present in the surface of the valve bushing 79. Two channels 85 and 86 empty into the groove 81, only one channel 85 being visible in FIG. 6. Two channels 87 and 88 empty into the groove 83, only channel 87 being visible in FIG. 6. A feed channel 89, which is visible only in FIG. 6 and is connected to the pipeline 31, empties into the middle groove 82. The upper end of the longitudinal bore 80 is connected with a drainage channel 90 and the lower end of the longitudinal bore is connected with a drainage channel 91. The two drainage channels 90 and 91 are connected to the return line 38. The valve slide 55 has two peripheral ribs 92 that contribute to delimiting an annular space 93. In the middle position, in which the valve slide 55 is shown in FIGS. 5 and 6, the annular space 93 is connected only through the middle groove 82 with the feed channel 89. If the valve slide 55 is brought into its lower position by actuating the control lever 18, pressurized oil passes from the annular space 93 into the channels 87 and 88, which were previously connected with the drain channel 91. Pressurized oil passes through the channel 87 into a channel 94 in the check valve block 53 to a check valve 95, and through the pipeline 41 to the drive cylinder 40 (see FIG. 2). The excess oil flows from the drive cylinder 40 through the pipeline 42 and the positively opened check valve 96, into a channel (not shown) in the check valve block 53, and from there into the channel 86 and through the assigned radial bore 84 into the drain channel 90, and then, as indicated above, back to the reservoir 21.

If the valve slide 55 is brought into its upper position, pressurized oil passes from the annular space 93 into the channels 85 and 86. The pressurized oil flows from the channel 86 through a channel (which is not shown, but which corresponds to the channel 94 in the check valve block 53), through the check valve 96 and the pipeline 42, to the drive cylinder 40 (see FIG. 2).

The excess oil flows from the drive cylinder 40 through the pipeline 41 into the check valve 95, which is positively opened in the manner described in the following, the channels 94 and 87 into the drain channel 91, and from there back into the reservoir 21.

The positive opening of the check valve 95 takes place through a piston 97 with a pin 98. The piston 97 is held by a pressure spring 99 in its rest position shown in FIG. 6. When the valve slide 55 is moved upward, pressurized oil also passes into the channel 85, and through a narrow channel 100 in the check valve block 53, into the working chamber on the left-hand side of the piston 97 with respect to FIG. 6. This causes the piston 97 with the pin 98 to be shifted to the right. The free end of the pin 98 strikes the movable valve body 101 of the check valve 95, which causes it to be positively opened against the return force of a valve spring 102. The check valve 96 is positively opened in an analogous manner if the valve slide 55 is moved downward. The axial passage through the guide sleeve 76 is reduced twice, and contains a supporting shoulder 103 on which a support plate 104 for a pressure spring 105 lies if the valve slide 55 is in the middle position. The other end of the pressure spring 105 rests on a support plate 106, which lies against the upper face of the valve sleeve 79 if the valve slide 55 is not in the upper position. Openings 107 are provided in the support plate 106 so that oil can flow out of the channels 85 and 86 into the drain channel 90, even if the support plate 106 lies against the valve sleeve 79. The pressure spring 105 assures that the piston rod 56 and the valve slide 55 are in the middle position shown in FIGS. 5 and 6 if no external force acts on the control lever 18 and the electric motor 68 is not energized.

For example, if the control lever 18 is swung backward into the drawing plane of the Figure, the follower pin 72 is moved upward. This upward movement is transferred from the follower pin 72 to the push rod 57, the piston rod 56, and the valve slide 55. The upward movement of the valve slide 55 also causes the support plate 106 to be moved upward against the returning force of the pressure spring 105. The pressure spring 105 is thus still further pretensioned so that it moves the valve slide 55 and the control lever 18 back into the middle position if an external force no longer acts in the control lever 18.

If the control lever 18 is actuated in the opposite direction, the follower pin 72 moves downward. This downward movement is transferred to the push rod 57, the piston rod 56, and the valve slide 55. The piston rod 56 has a support shoulder 108 on which the support plate 104 lies during the downward movement and is also shifted downward. The pressure spring 105 is thus pretensioned because the support plate 106 lies against the face of the valve sleeve 79. If an external force no longer acts on the control lever 18, the pressure spring 105 assures the return of the control lever 18 and the valve slide 55 to the middle position.

Movements analogous to the upward and downward movements described above are also effected if the electric motor 68 is energized so that it generates a torque in one direction or another.

The valve slide 55, and thus the drive cylinder collaborating with it, can be controlled without additional measures at any time by actuating either the control lever 18 or the remote control device.

In order to prevent the electric motor 44 from becoming overheated during more prolonged energization, and to save energy, a limit switch 68 is provided. The limit switch 68 acts with an axial projection 132 on the face of the shaft journal 62 adjacent to the bevel gear 64. The projection 132 extends over an angle of ca. 60° and is designed so that if the valve slide 55 is in the middle position, the trip stop 133 of the limit switch 68 lies in the middle of the axial projection 132. As long as the trip stop 133 lies on the projection 132, the limit switch 68 is closed. A resistance 134 is switched parallel to the limit switch 68 and it is switched in series to the electric motor 44 (see FIG. 2). After a rotation of ca. 30° in the shaft journal 62 in one direction or another, the trip stop 133 slips off the projection 132 and the limit switch 68 opens. As a result, the series-switching of the resistance 134 to the electric motor 44 becomes active. The current through the electric motor 44 is reduced by the resistance 134 so sharply that the residual torque is precisely sufficient to counteract the restoring force of the pressure spring 105. In this manner, the valve slide 55 remains in its upper or lower position as long as the electric motor 44 remains energized.

Figure 8:
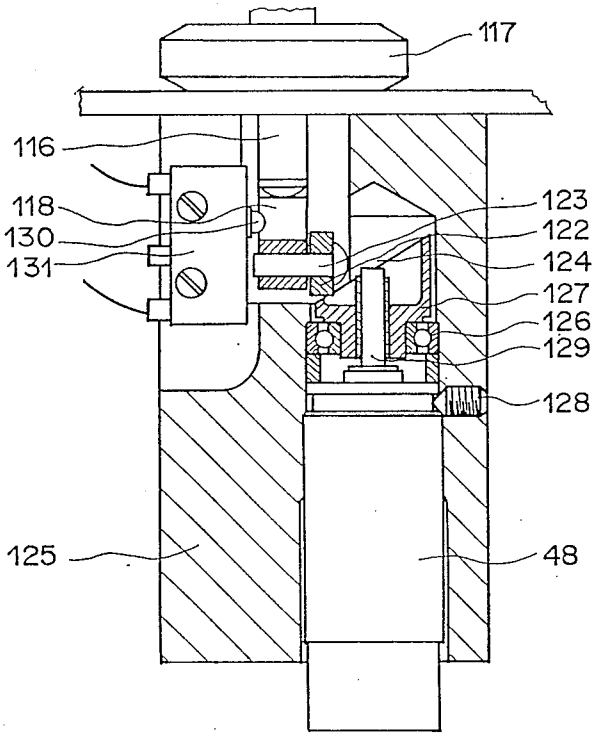
FIG. 8 shows a section along the line VIII—VIII of FIG. 7.
Figure 7:
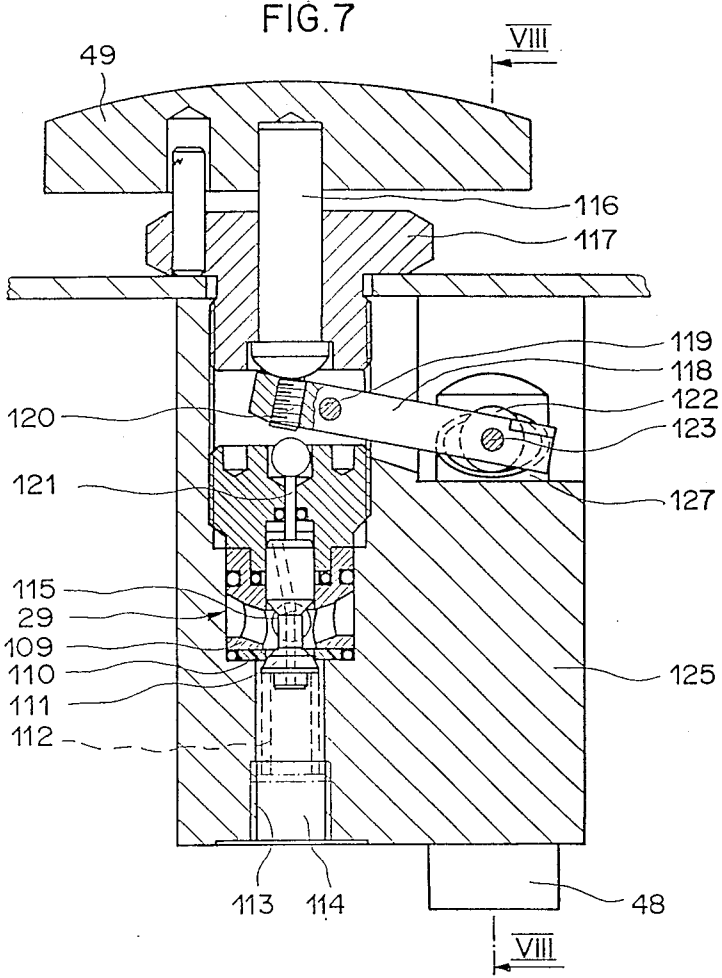
FIG. 7 shows a section through a foot switch that is located in the base of the operating table.

It is evident from FIG. 2 that it is still necessary to actuate the foot switch 49 in addition to actuating the control lever 18 or 15 in order to control the drive cylinders 36 and 40. The standby valve 29 is thus opened and the pressurized oil can pass from the pressure accumulator 23 into the feed channel 89 in the control valve block 51. The standby valve 29 is shown in cross section in FIG. 7. It is comprised of a stationary valve body 109 with a valve seat 110, a movable valve body 111, and a valve spring 112 that presses the movable valve body 111 against the valve seat 110. The pipeline coming from the pressure accumulator 23 is connected to a connection 114 provided with threads 113. Pressurized oil passes through an outlet channel 115 to the control panel 14 when the standby valve 29 is opened. The foot switch 49 is fastened to a bolt 116 that extends through a guide sleeve 117. The inner end of the bolt 116 acts on one arm of a two-armed lever 118 that is pivotable around an axis 119. A setscrew 120 is screwed into the arm on which the bolt 116 acts directly, and it can actuate the said valve body through a projection 121 operatively connected with the movable valve body 111 to open the standby valve 29. A roller 122 is supported on a shaft 123 on the other arm of the lever 118. A ball bearing 126, in which a cup-shaped swash plate 127 is supported (FIG. 8), is located in a recess 124 of the housing block 136 of the standby valve 29. The roller 122 rolls on the edge of the swash plate 127. If the swash plate 127 turns in one direction or another, the lever 119 is swung counterclockwise with respect to FIG. 7, and the movable valve body 111 is lifted from its valve seat 110. The electric motor 48 is also placed in the said recess 124 and fixed with the aid of a setscrew 128. The drive shaft 129 of the electric motor 48 is connected with the swash plate 127 in a rotationally solid manner. A trip stop 130 of a limit switch 131 projects into the movement path of the lever 118.

As is evident from FIG. 2, a resistance is switched in series to the electric motor 48. The limit switch 131 is switched parallel to the resistance 135. The limit switch 131 is designed so that the lever 118 presses the trip stop 130 into the limit switch 131, and thus opens the latter if the lever 118 is swung counterclockwise with respect to FIG. 7 and has displaced the projection 121 downward to open the standby valve 29. Analogously, as also described above with reference to the resistance 134 assigned to the electric motor 44, the resistance 135 is dimensioned so that the reduced current flowing through the electric motor 48 still generates an adequate torque that prevents the lever 118 from returning prematurely to its rest position.

The standby valve 29 can be opened either by actuating the foot switch 49 or by energizing the electric motor 48, in which case the actuation of the foot switch 49 and energization of the electric motor can be effected directly, simultaneously, and without causing damage.

The electric motors 43, 44, and 48 preferably have built-in gear drives with a gear ratio of 76:1, for example. The current necessary for driving the electric motors and delivered by the driver stage 47 can thus be further reduced.

The receiver 46 shown in FIG. 2 and driver stage 47 derive their power required for operation from a rechargeable battery 136 that is located in a battery charger 137. The a.c. connections of the battery charger 137 are switched parallel to the connections of the electric motor 19 that drives the pump 20; thus, the battery 136 is simultaneously charged with the accumulators of pressurized oil in the pressurized oil accumulator 23. The pressurized oil accumulator 23 and the battery 136 are preferably dimensioned so that the energy stored in them is sufficient for operating the operating table for one day.

Although the preferred embodiment of this invention has been shown and described, it should be understood that various modifications and rearrangements of the parts may be resorted to without departing from the scope of the invention as disclosed and claimed herein.

What is claimed is:

1. An operating table having a patient support surface, said support surface being tiltable about a longitudinal axis and about a transverse axis, said support surface being comprised of a plurality of segments, pivot means pivotally connecting each segment to at least one other segment, individual drive means for tilting the patient support surface about its longitudinal axis and about its transverse axis for pivoting each segment about its pivot means and relative to at least one other segment, a control panel fixed to said table with a plurality of manually operable control levers for manually operating said individual drive means, actuator means for operating said individual drive means, and a remote control device having a sender and a receiver, said receiver having a driver stage with outputs for energizing said actuator means from a location remote from said table, characterized in that the actuating means are electromagnetic devices (43, 44, 48) and that each of the electromagnetic devices is functionally connected with one of the control levers (15–18) to operate that lever from a remote location and is connected electrically with an output of the driver stage (47).

2. An operating table according to claim 1, in which the patient support surface is supported on a support column that stands on a movable table base and the drive means are hydraulic drive cylinders, characterized in that the electromagnetic devices are electric motors (43, 44, 48).

3. An operating table according to claim 2, characterized in that a control valve (32, 33) for controlling pressurized oil fed to the pertinent drive cylinder (36, 40) is assigned to each of the control levers (15–18), that the control valve has a valve bushing (79) and valve slide (55) capable of sliding therein, and that means (56, 57, 72) are present for shifting the valve slide (55) as a function of the swiveling of the assigned control lever.

4. An operating table according to claim 3, characterized in that the means for shifting the valve slide (55) are comprised of a follower pin (72) situated eccentrically on a shaft journal (62), a push rod (57), and a piston rod (56), that one end of the piston rod (56) is fastened to the valve slide (55) and the other end is pivotably connected with the one end of the push rod (57) through a coupling piece (75), that the other end of the push rod (57) is passed through by the follower pin (72) and that the end of the follower pin (72) that projects above the push rod projects into a radial groove (73) of a shaft journal (58) penetrated by the control lever (15).

5. An operating table according to claim 4, characterized in that the electric motor (44) is rotatably connected with the shaft journal (62) having the follower pin (72) and is connected in series with a resistance (134), that a limit switch (68) that responds to a certain angle on the rotation of the said shaft journal (62) is present and that the limit switch (68) is switched parallel to the resistance and bridges the resistance (134) as long as the shaft journal (62) turns inside of the specified angle.

6. An operating table according to claim 5, characterized in that a reduction gearing is built onto the electric motor (44) and that its output shaft (70) is rotatably connected through a gear unit comprised of two bevel gears (64, 66) with the shaft journal (62) that has the follower pin (72).

7. An operating table according to one of claims 3–6, with a standby valve (29) having a foot switch (49), characterized in that an electric motor (48) is assigned to the standby valve (29), that means are present (118, 122, 127) for converting the rotational movement of the electric motor (48) into an axial displacement movement of the movable valve body (111) of the standby valve (29), that a resistance (135) is switched in series to the electric motor (48), that a limit switch (131) that responds to the setting of the means (118, 122, 127) for conversion of the rotational movement is present, and that the limit switch (131) is switched in parallel to the resistance for short-circuiting the said resistance (135) if the means for conversion of the rotational movement are in the rest position.

8. An operating table according to claim 7, characterized in that the means for converting the rotational movement have a lever (118) pivotable around an axis (119), a roller (122) rotatably situated on one end of the lever, and a swash plate (127) rotatably connected with the electric motor (48), that the roller (122) is designed to roll on the edge region of the swash plate (127), and that the trip stop (130) of the limit switch is located in the path of movement of the lever.

* * * * *